US007052292B2

(12) United States Patent
Hsu et al.

(10) Patent No.: US 7,052,292 B2
(45) Date of Patent: May 30, 2006

(54) GROUNDING STRUCTURE OF AN ELECTRICAL CONNECTOR

(75) Inventors: I-Chang Hsu, Taipei Hsien (TW); Fu-Chen Chou, Taipei Hsien (TW); Pi-Ching Chen, Taipei Hsien (TW)

(73) Assignee: Comax Technology Inc., Taipei Hsien (TW)

( * ) Notice: Subject to any disclaimer, the term of this patent is extended or adjusted under 35 U.S.C. 154(b) by 0 days.

(21) Appl. No.: 10/815,688

(22) Filed: Apr. 2, 2004

(65) Prior Publication Data

US 2005/0176300 A1 Aug. 11, 2005

(30) Foreign Application Priority Data

Feb. 11, 2004 (TW) ..... 93201909 U

(51) Int. Cl.
*H01R 4/66* (2006.01)

(52) U.S. Cl. ..... 439/98; 439/610

(58) Field of Classification Search ..... 439/608, 439/609, 610, 98, 99, 610 X
See application file for complete search history.

(56) References Cited

U.S. PATENT DOCUMENTS 4,682,840 A * 7/1987 Lockard ..... 439/874
4,826,443 A * 5/1989 Lockard ..... 439/101
4,887,971 A * 12/1989 Reuss et al. ..... 439/98
4,981,447 A * 1/1991 Ichitsubo ..... 439/607
5,387,130 A * 2/1995 Fedder et al. ..... 439/610
5,409,400 A * 4/1995 Davis ..... 439/610
5,419,709 A * 5/1995 Onoda ..... 439/95
5,460,533 A * 10/1995 Broeksteeg et al. ..... 439/108
5,466,175 A * 11/1995 Onoda ..... 439/610
5,495,075 A * 2/1996 Jonckheere et al. ..... 174/74 R
5,518,421 A * 5/1996 Davis ..... 439/607
5,525,066 A * 6/1996 Morlion et al. ..... 439/108
5,554,038 A * 9/1996 Morlion et al. ..... 439/108
5,588,851 A * 12/1996 Morlion et al. ..... 439/108
5,632,634 A * 5/1997 Soes ..... 439/101
6,039,606 A * 3/2000 Chiou ..... 439/610
6,165,016 A * 12/2000 Lai ..... 439/610
6,336,827 B1 * 1/2002 Akama et al. ..... 439/610
6,444,902 B1 * 9/2002 Tsao et al. ..... 174/36
6,454,605 B1 * 9/2002 Bassler et al. ..... 439/609
6,482,028 B1 * 11/2002 Kumamoto et al. ..... 439/498
6,489,563 B1 * 12/2002 Zhao et al. ..... 174/88 C
6,524,135 B1 * 2/2003 Feldman et al. ..... 439/610
6,585,536 B1 * 7/2003 Wu ..... 439/358
6,585,537 B1 * 7/2003 Lee ..... 439/358
6,623,299 B1 * 9/2003 Liu ..... 439/604

(Continued)

*Primary Examiner*—Ross Gushi
(74) *Attorney, Agent, or Firm*—Troxell Law Office, PLLC

(57) ABSTRACT

The present invention relates to a grounding structure of an electrical connector suitable for high frequency transmitting. The high frequency connector mainly has a connecting part being combined with a plurality of grounding lines to improve the electrical characteristics of the high frequency connector when it transmits a signal. Wherein, the connecting part further comprises a wing portion and a protrusion portion; thereby the connecting part can engage the grounding terminals with the grounding line of the cable to form electrical contact. Furthermore, one end of the connecting part is extended directly and comprises predetermined grounding terminals, such that the grounding line can be directly connected to connecting part; such as, the electrical connector can have better electrical characteristics and the grounding line can directly be coupled to the grounding terminals without the soldering process by using aforesaid structure meanwhile, the entire assembly process and the relative cost can be lessened.

9 Claims, 4 Drawing Sheets

U.S. PATENT DOCUMENTS 6,630,624 B1 * 10/2003 Tsao et al. ..... 174/36
6,641,429 B1 * 11/2003 Wu ..... 439/465
6,653,569 B1 * 11/2003 Sung ..... 174/88 R
6,663,415 B1 * 12/2003 Wu ..... 439/460
6,722,898 B1 * 4/2004 Peloza et al. ..... 439/108
6,739,883 B1 * 5/2004 Cheng et al. ..... 439/98
6,740,808 B1 * 5/2004 Chang ..... 174/36
6,764,342 B1 * 7/2004 Murayama et al. ..... 439/608
6,773,293 B1 * 8/2004 Lee ..... 439/357
6,776,646 B1 * 8/2004 Lee ..... 439/357
6,790,075 B1 * 9/2004 Sung ..... 439/499
6,803,518 B1 * 10/2004 Chang ..... 174/36
6,817,898 B1 * 11/2004 Tanaka et al. ..... 439/579
6,821,139 B1 * 11/2004 Wu ..... 439/352
6,830,472 B1 * 12/2004 Wu ..... 439/358
6,830,483 B1 * 12/2004 Wu ..... 439/638
6,843,683 B1 * 1/2005 Cheng ..... 439/606
6,846,188 B1 * 1/2005 Hsin et al. ..... 439/79
6,860,749 B1 * 3/2005 Wu ..... 439/352
6,860,750 B1 * 3/2005 Wu ..... 439/358
6,866,539 B1 * 3/2005 Chang ..... 439/460
6,869,306 B1 * 3/2005 Sung ..... 439/449
6,875,048 B1 * 4/2005 Lee ..... 439/497
6,890,205 B1 * 5/2005 Wu ..... 439/358
6,896,556 B1 * 5/2005 Wu ..... 439/638
6,951,477 B1 * 10/2005 Tondreault et al. ..... 439/497
6,955,565 B1 * 10/2005 Lloyd et al. ..... 439/607
2004/0121647 A1 * 6/2004 Chang ..... 439/460
2004/0127078 A1 * 7/2004 Tondreault et al. ..... 439/98
2005/0085128 A1 * 4/2005 Chai et al. ..... 439/607
2005/0176305 A1 * 8/2005 Wu ..... 439/660
2005/0233631 A1 * 10/2005 Wu ..... 439/352
2005/0272303 A1 * 12/2005 Wu ..... 439/499
2005/0282443 A1 * 12/2005 Wu ..... 439/694

* cited by examiner

GROUNDING STRUCTURE OF AN ELECTRICAL CONNECTOR

BACKGROUND OF THE INVENTION

1. Field of the Invention

The present invention relates to a grounding structure of an electrical connector suitable for high frequency transmitting. The high frequency connector mainly has a connecting part being combined with a plurality of grounding lines to improve the electrical characteristics of the high frequency connector when it transmits a signal, and the grounding line of the high frequency connector can directly be coupled to the grounding terminals without a soldering process such that the entire assembly process and the relative cost can be lessened.

2. Description of the Related Art

Generally, most grounding structure of the prior art connector used on the motherboard of the computer mainly is soldered directly to the grounding line and the grounding terminals, however, due to the science and technology increasing continuously and the environmental protection sense raising, the assembly process of the electronic industry is leading to lead-ness process progressively.

One of the grounding structures of the prior art connector has been found in the U.S. Pat. No. 6,489,563 B1 patent, wherein, the patent uses a grounding sleeve as a contact between the grounding line and grounding terminals; however, the grounding sleeve still needs to be soldered to the grounding terminals so as to form electrical contact.

However, the grounding design of the connector according to the U.S. Pat. No. 6,489,563 B1 patent may improve the electrical characteristics, but it has no contribution to the environmental protection considering and assembly process; besides it easily generates environmental pollution during the soldering process, it also easily causes departing effect if the soldering process is not complete or not certain, further, decreases the grounding effect and electrical characteristics; meanwhile, the assembly structure of the prior art not only increases the cost and wastes man power, but has a poor yield rate, such that the manufacturing cost is increased for no reason and does not conform to cost effectiveness.

SUMMARY OF THE INVENTION

According to one aspect of the present invention, the present invention provides a high frequency connector with an easy connecting part, which overcomes some, or all of the previously delineated drawbacks of the prior art connector that makes the connector to have the best electrical characteristics.

For reaching the aforesaid object, wherein, the connecting part comprises a wing portion and a protrusion portion; thereby the connecting part can engage the grounding terminals with the grounding line of the cable to form electrical contact. Furthermore, one end of the connecting part is extended directly and comprises predetermined grounding terminals, such that the grounding line can be directly connected to the connecting part; such as, the electrical connector can have better electrical characteristics and the grounding line can directly be coupled to the grounding terminals without the soldering process by using the aforesaid structure, meanwhile, the entire assembly process and the relative cost can be lessened.

BRIEF DESCRIPTION OF THE DRAWING PORTIONS

DETAILED DESCRIPTION OF THE PREFERRED EMBODIMENT

Figure 1:
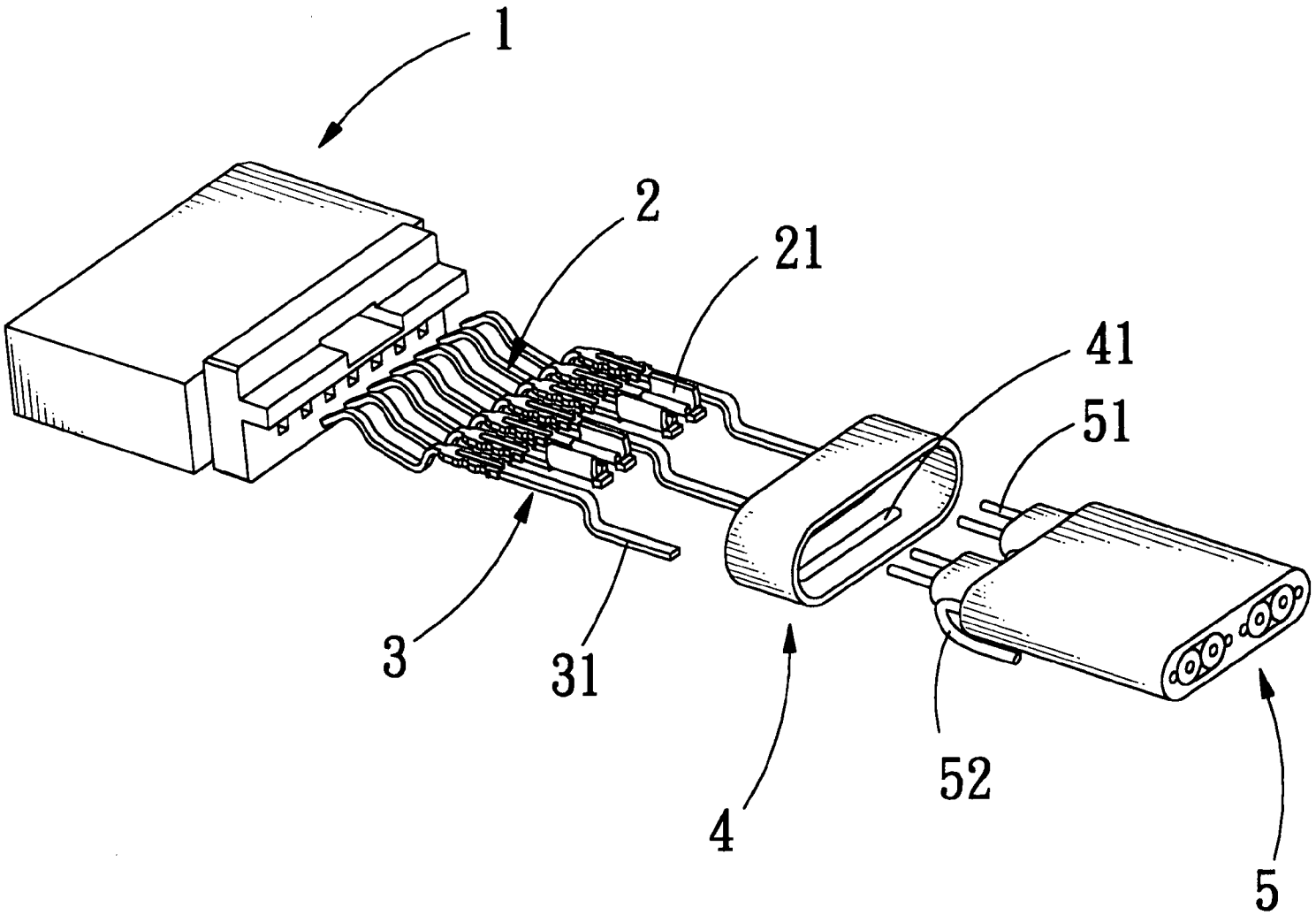
FIG. 1 shows an exploded view of the grounding structure according to one embodiment of the present invention.
Figure 2:
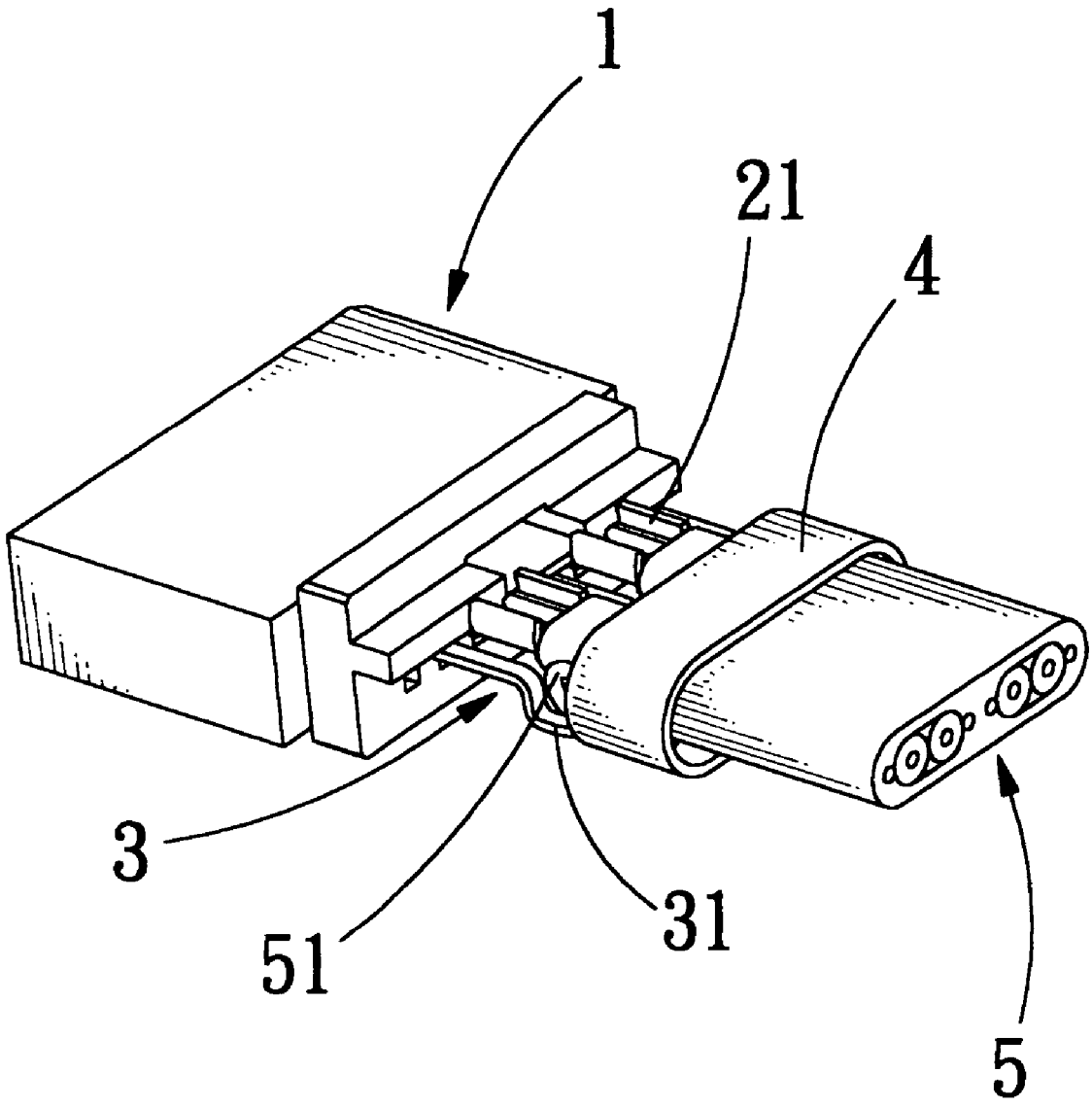
FIG. 2 shows an assembly view of the grounding structure according to one embodiment of the present invention.

Referring to FIGS. 1-2, which show the exploded view and assembly view of the grounding structure according to one embodiment of the present invention. As shown in FIGS. 1 and 2, the grounding structure of the present invention mainly comprises: a housing 1; predetermined transmitting terminals 2 and grounding terminals 3 inserted inside the housing 1; a cable 5, comprising a predetermined number transmitting units 51 and grounding lines 52; and a connecting part 4, engaging the grounding terminals 3 with the grounding line 52 to form electrical contact. Each of the plurality of transmitting units having one of the plurality of grounding lines located on each of two opposing sides thereof.

Wherein, the connecting part 4 is a sheath with electrical contact material, preferably, and it further comprises a protrusion portion 41 installed at the appropriate position to increase the contact effect and the protrusion portion 41 can be formed into a protrusion shape by the pressing process to improve the electrical contact.

As shown in FIGS. 1 and 2, the grounding structure of the present invention mainly engaged the signal transmitting units 51 with the receiving end 21 of the transmitting terminals 2 inserted inside the housing 10. Then, each grounding line 52 (please refer to FIG. 1) is bent and each, is bent and each grounding line 52 and the engaging end 31 of the grounding terminals 3 are provided over the protrusion portion 41 of the connection part 4, and then pressed and fitted tightly to the connecting part 4, such that the grounding line 52, the grounding terminals and the connecting part 4 could form electrical contact.

Figure 3:
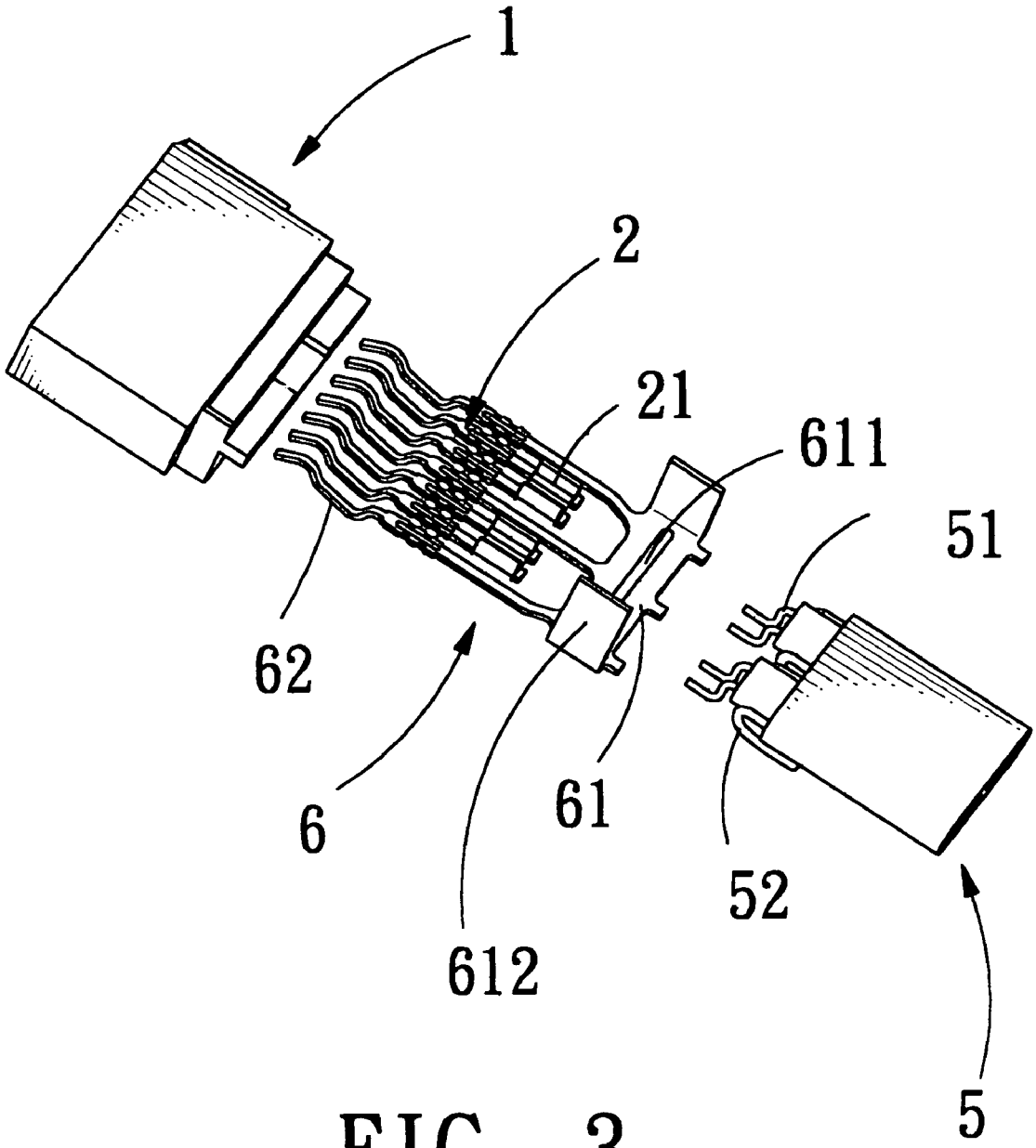
FIG. 3 shows an exploded view of the grounding structure according to another embodiment of the present invention.
Figure 4:
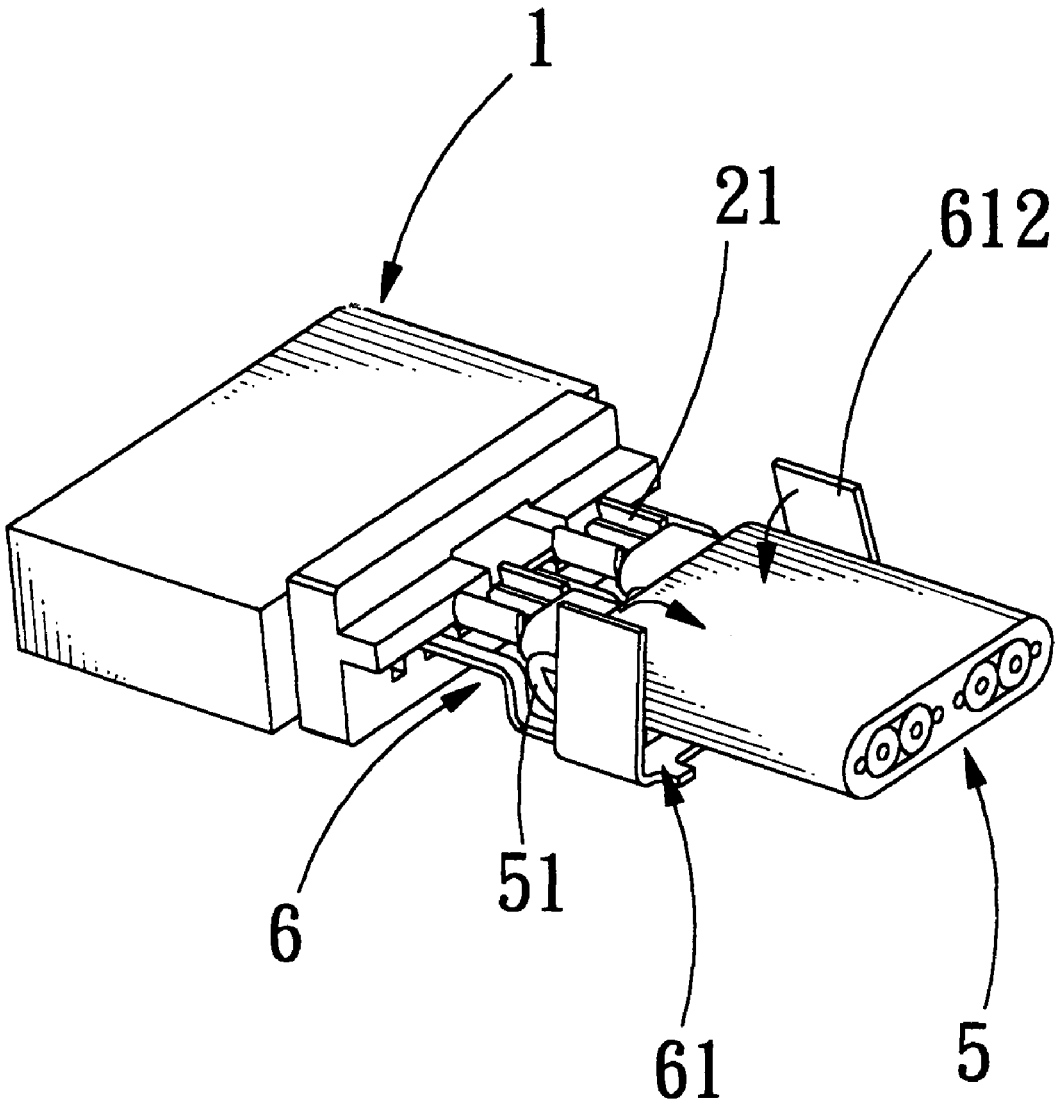
FIG. 4 shows an assembly view of the grounding structure according to another embodiment of the present invention.

In order to prevent the grounding terminals 3 departing from the connecting part 4, please refer to FIGS. 3 and 4, which show the exploded view and assembly view of the grounding structure according to another embodiment of the present invention. As shown in the FIGS., wherein, the connecting part 6 comprises predetermined grounding terminals 62 extended directly from one end of the connecting part 6, and the other end comprises a press-fitted end 61; the press-fitted end 61 also comprises a protrusion portion 611 for electrical contacting; and both sides of the protrusion portion 611 respectively has a wing portion 612 for holding.

As shown in FIG., the grounding structure according to another embodiment of the present invention also engaged the signal transmitting units 51 with the receiving end 21 of the transmitting terminals 2 inserted inside the housing 10, and then bent the grounding line 52 (please refer to FIG. 3), finally, positioned the bent grounding line 52 over the protrusion portion 611 of the connection part 6, and then pressed and fitted inwardly and tightly the wing portions 612 of the two sides of the connecting part 6, such that the grounding line 52 and the connecting part 6 could make electrical contact.

Wherein, the connecting part 6 is made of electrical contact material; and the protrusion portion 611 also can be formed into a protrusion shape by the pressing process to improve the electrical contact.

Therefore, the connecting part of the present invention engages the grounding terminals with the grounding line of the cable securely so that the electrical connector could have better electrical performance.

Therefore, the present invention relates to a grounding structure of an electrical connector suitable for high frequency transmitting. The high frequency connector mainly has a connecting part being combined with a plurality of grounding lines to improve the electrical characteristics of the high frequency connector when it transmits signal, and the grounding line of the high frequency connector can directly be coupled to the grounding terminals without the soldering process such that the entire assembly process and the relative cost can be lessened.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A cable connector comprising:

a) a housing;

b) a plurality of transmitting terminals and grounding terminals inserted inside said housing;

c) a cable having a plurality of transmitting units and grounding lines, each of the plurality of transmitting units having one of the plurality of grounding lines located on each of two opposing sides thereof; and d) a connecting part having a protrusion portion engaging said plurality of grounding terminals with said plurality of grounding lines forming an electrical contact.

2. The cable connector according to claim 1, wherein said connecting part is a sheath with an electrical contact material.

3. The cable connector according to claim 1, wherein said protrusion portion is formed by a pressing process.

4. The cable connector according to claim 1, wherein said plurality of grounding lines are bent and connected to said connecting part.

5. A cable connector comprising:

a) a housing;

b) a plurality of transmitting terminals inserted inside said housing;

c) a cable having a plurality of transmitting units and grounding lines, each of the plurality of transmitting units having one of the plurality of grounding lines located on each of two opposing sides thereof; and d) a connecting part having a protrusion portion located on a second end, the protrusion portion being forced and coupled to said plurality of grounding lines forming an electrical contact, wherein a first end of said connecting part is extended directly and has a plurality of grounding terminals inserted into said housing.

6. The cable connector according to claim 5, wherein said connecting part is made of an electrical contact material.

7. The cable connector according to claim 5, wherein the connecting part includes a wing portion extending from each of two ends of the protrusion portion.

8. The cable connector according to claim 5, wherein said protrusion portion is formed by a pressing process.

9. The cable connector according to claim 5, wherein said plurality of grounding lines are bent and connected to said connecting part.

* * * * *